US007011473B2

(12) United States Patent
Tangen et al.

(10) Patent No.: US 7,011,473 B2
(45) Date of Patent: Mar. 14, 2006

(54) METHOD FOR UNDERWATER TRANSPORTATION AND INSTALLATION OR REMOVAL OF OBJECTS AT SEA

(75) Inventors: Gunnar Tangen, Stol (NO); Lars Hvam, Stavanger (NO)

(73) Assignee: Aker Marine Contractors AS, Oslo (NO)

( * ) Notice: Subject to any disclaimer, the term of this patent is extended or adjusted under 35 U.S.C. 154(b) by 0 days.

(21) Appl. No.: 10/506,224

(22) PCT Filed: Mar. 6, 2003

(86) PCT No.: PCT/NO03/00078

§ 371 (c)(1),
(2), (4) Date: Aug. 31, 2004

(87) PCT Pub. No.: WO03/074353

PCT Pub. Date: Sep. 12, 2003

(65) Prior Publication Data

US 2005/0152748 A1 Jul. 14, 2005

(30) Foreign Application Priority Data

Mar. 6, 2002 (NO) ..... 20021119

(51) Int. Cl.
*E02B 17/00* (2006.01)
*B63B 35/00* (2006.01)

(52) U.S. Cl. ..... 405/209; 405/206; 405/203

(58) Field of Classification Search ..... 405/195.1, 405/203, 204, 206, 209
See application file for complete search history.

(56) References Cited

U.S. PATENT DOCUMENTS

| | | | | |
|---|---|---|---|---|
| 4,690,586 A | | 9/1987 | Oksuzler | |
| 4,797,035 A | * | 1/1989 | Hunter | 405/209 |
| 4,828,430 A | * | 5/1989 | van der Heyden | 405/209 |
| 4,927,296 A | | 5/1990 | Kaldenbach | |

(Continued)

FOREIGN PATENT DOCUMENTS

| | | |
|---|---|---|
| GB | 1191146 A | 5/1970 |
| GB | 2222190 A | 2/1990 |

OTHER PUBLICATIONS

International Search Report dated May 19, 2003 for PCT/NO03/00078.

(Continued)

*Primary Examiner*—Frederick L. Lagman
(74) *Attorney, Agent, or Firm*—Myers Bigel Sibley & Sajovec, P.A.

(57) ABSTRACT

Method for transport and installation of objects at sea, particularly relating to transport and installation of obs jects that are part of the infrastructure in oil and gas fields offshore, the object (4) is put in the sea at a suitable location near the shore or in sheltered waters, then towed to the installation site while being suspended in a slender buoyancy unit (5) acting much like a heave compensating unit. Upon arrival at the installation site, the suspension of the object (4) is transferred from the buoyancy unit (5) to a heave compensated winch (3) on a surface vessel (2), preferably the same vessel as used for the preceding towing operation. The winch is used to lower is the object (4) to its destination on the sea bottom or a predetermined location above the sea bottom.

20 Claims, 10 Drawing Sheets

U.S. PATENT DOCUMENTS

| | | | | |
|---|---|---|---|---|
| 4,974,536 | A | 12/1990 | Archibald | |
| 5,190,107 | A * | 3/1993 | Langner et al. | 405/209 |
| 5,215,410 | A | 6/1993 | Karal | |
| 6,354,765 | B1 * | 3/2002 | Jones | 405/203 |
| 2001/0018009 | A1 | 8/2001 | de Waard et al. | |
| 2001/0053311 | A1 | 12/2001 | Jones | |

OTHER PUBLICATIONS

International Preliminary Report on Patentability dated Jan. 1, 2004 for PCT/NO03/000078.

Norwegian Search Report dated Aug. 7, 2002 for Patent Application No. 2002 1119.

* cited by examiner

METHOD FOR UNDERWATER TRANSPORTATION AND INSTALLATION OR REMOVAL OF OBJECTS AT SEA

RELATED APPLICATIONS

The present application is a National Phase application of PCT/N003/00078 filed on Mar. 6, 2003 and publish in English, which claims priority from Norwegian Patent Application No. 20021119 filed on Mar. 6, 2002, the disclosure of which is incorporated herein by reference.

FIELD OF THE INVENTION

Oil and gas field developments are experiencing a push towards underwater production with more of the infrastructure placed on the seabed. There is thus an increasing need for transportation of objects with subsequent installation of the objects at the field. Also, with an increasing number of oil and gas fields being decommissioned, there is a growing need for removal of objects with subsequent transport to shore. Some of the objects that are to be installed or removed from the offshore sites are relatively complicated with large dimensions and weights. One is often dependent on costly vessels and equipment, and the availability of such vessels may also be poor. Based on these aspects there is a need to develop new and alternative methods for transport and installation/removal of objects, as conventional methods become unfit, inadequate or very expensive.

The more conventional methods are normally based on transporting the objects to the destination on deck of the installation vessel or a transportation barge, with subsequent offshore lift from deck and lowering of object through the splash zone/sea surface using a crane. Such operations set high demands to crane capacity and deck space, and can be very weather sensitive operations depending on type of object to be installed and the motion characteristics of the installation vessel(s). They further require costly construction vessels and potentially tying them up for long periods of time depending on weather.

Thus, the present invention, in a first aspect, relates to a method for transport and installation of objects at sea, particularly relating to transport and installation of objects that are part of the infrastructure in oil and gas fields offshore, where the object is put in the sea at a suitable location near the shore or in sheltered waters, then towed to the installation site while being suspended in at least one floating buoyancy unit, and subsequently lowered to its final destination.

A method of this type is known from GB 1191146. In this method two slightly different types of buoys are used for suspending a pipeline while it is being towed from the shore to its place of installation. At the installation site, the pipeline is lowered to the sea bottom by flooding the buoys, some of them deliberately and others automatically through the implosion of bursting disks so as to fill their buoyancy chambers at a predetermined depth. The lowering of the pipeline is started from one end, and if the water is deep, a substantial part of the pipeline will be suspended in the still floating part before the first end reaches the bottom, thus subjecting part of the pipeline to very substantial bending loads and possibly also causing the lowering process to become out of control. GB 1191146 is silent on the possible recovery of the buoys after the pipeline has reached the bottom. In any case, such recovery work would be quite complicated, particularly at greater depths.

U.S. Pat. No. 4,690,586 discloses a method for installing the jacket of an offshore platform structure, wherein the jacket is towed on a barge to the installation site. At the site the barge is submerged by means of tension legs and ballasting so that the jacket may be pulled off the barge while in floating condition. This method is only possible for objects that have sufficient buoyancy to be self-floating and can therefore not satisfy the first aspect of the present invention as mentioned above. Besides, the installation of temporary tension legs for the barge adds considerably to the complexity and cost of this method, which also seems limited to shallow waters and good weather conditions.

According to a second aspect, the present invention also relates to a method for removal and transport of objects at sea. In this respect, US 2001/0053311 discloses the use of a sea going crane vessel for raising a jacket structure or the like to a horizontal position so that it may be suspended at either end of a barge. The suspension points on the barge are releasable rocker beams in order to facilitate quick release of the jacket once it has been towed to a place where it can be dumped at deep water. This method is limited to water depths where jackets may be used and where the object may be raised one end at a time. The dimensions of the barge must correspond approximately to the length of the object. The barge will have a substantial water line cross-section and therefore respond to wave motion, and with the object suspended in releasable rocker beams it will not be possible to lower the object in a controlled manner after its release.

Thus, the purpose of the present invention is to provide a method as defined in the preamble of claims 1 and 2, respectively, which is safe and simple and may be performed with the use of readily available equipment even when the weather conditions are not favourable.

SUMMARY OF THE INVENTION

The transport and installation method may be summarised as follows:

The object is transported from the fabrication yard to a suitable location inshore or a location in sheltered waters or a location near shore with the appropriate weather to perform the transfer operations. An inshore crane vessel will then pick up the object from the transportation barge or transportation vessel and lower the object through the splashzone/sea surface with subsequent hook-up and weight transfer to the buoyancy unit and towing arrangement, according to the invention. The object will then be towed to the destination by a towing vessel while immersed and suspended from the buoyancy unit. On arrival at the destination the towing winch wire from the towing vessel will be shortened to take the weight of the suspended object and enable release of the buoyancy unit. The buoyancy unit will be released from the object when it no longer carries any weight, and subsequently stored on deck of or alongside of the towing/installation vessel, or other vessel, with post-installation transport back to shore either on deck or towed in a horizontal position, respectively. The object will then be lowered to the seabed or to a specified target depth between the surface and the seabed for installation with the heave compensated towing winch wire from the towing vessel or other vessel with heave compensated lifting arrangement.

This is obtained by a method as recited in claim 1.

The invention also relates to removal operations as defined in claim 2.

When applying the invention one achieves a number of advantages compared to conventional methods. In particular, one avoids the problems and weather restrictions associated with an offshore lift from deck and subsequent lowering through the splashzone/sea surface. Avoiding using crane vessels and improving the weather criteria for the installation will also result in a major reduction in cost for the operation, and the invention is in principle independent of dimensions and weight of the object to be transported and installed. Further, the transport to destination is safer and less weather sensitive since the object is suspended from a slender buoyancy unit and is independent of the installation vessel during transport. The buoyancy unit has a small and constant waterplane area and acts as a heave compensator, thereby reducing the dynamic loads in the object and the suspension arrangement between the object and buoyancy unit. The method can be based on using the same vessel for both the tow and the installation or recovery, and a minimum of equipment is needed. This means that any vessel that satisfies the basic capacity requirements may be used, which increases vessel availability, opens for using low cost vessels and reduces vessel mobilisation time.

BRIEF DESCRIPTION OF THE DRAWINGS

The present invention shall be described in more detail in the following with reference to the attached schematic drawings which illustrate a preferred embodiment, wherein.

DETAILED DESCRIPTION OF EMBODIMENTS OF THE INVENTION

Figure 1:
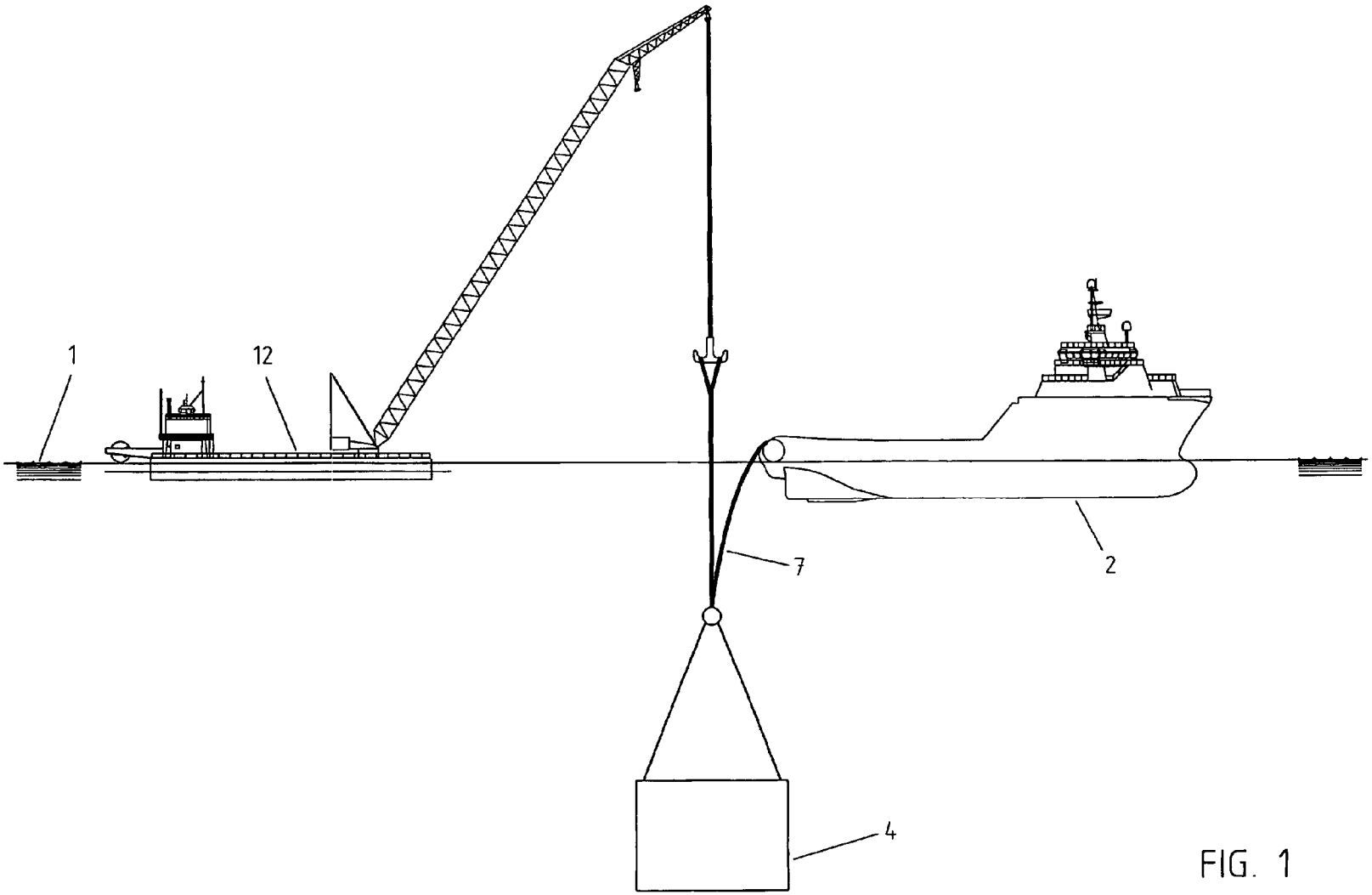
FIG. 1 is a side view showing how a typical inshore crane vessel lifts the object from deck of a vessel or a transportation barge and lowers it into the sea for connection to the towing vessel.

FIG. 1 shows the start of the operation according to the invention. The object 4 is being lifted through the surface 1 into the sea in sheltered waters after having been lifted off the deck of a vessel or transportation barge by a crane vessel 12. The object will be connected to the lower part of the suspension arrangement 7 and hung off in shark jaws at the stern of the towing vessel 2. The lifting wire from the crane vessel is then disconnected from the object.

Figure 2:
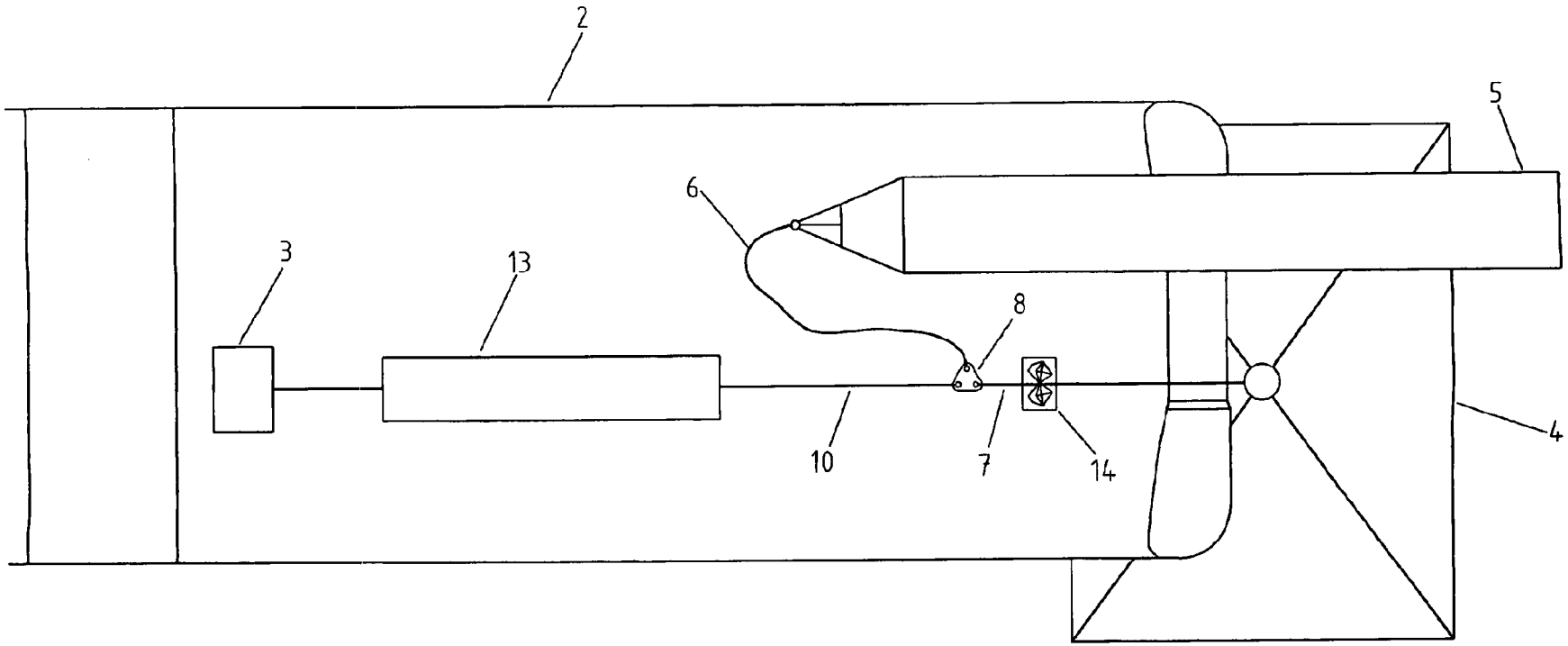
FIG. 2 is a plan view showing the connection of the buoyancy unit and the towing wire to the suspension arrangement while the object is hanging below the stern of the towing vessel and the buoyancy unit lying on deck of the towing vessel.

FIG. 2 shows the object 4 hanging just beneath the stern of the towing vessel 2, hung off in the shark jaws 14. The buoyancy unit 5 is lying on deck of the vessel and is connected to the tri-plate 8. The towing winch wire 10, running from the towing winch 3 via a heave compensator 13 on deck, is also connected to the tri-plate.

Figure 3A:
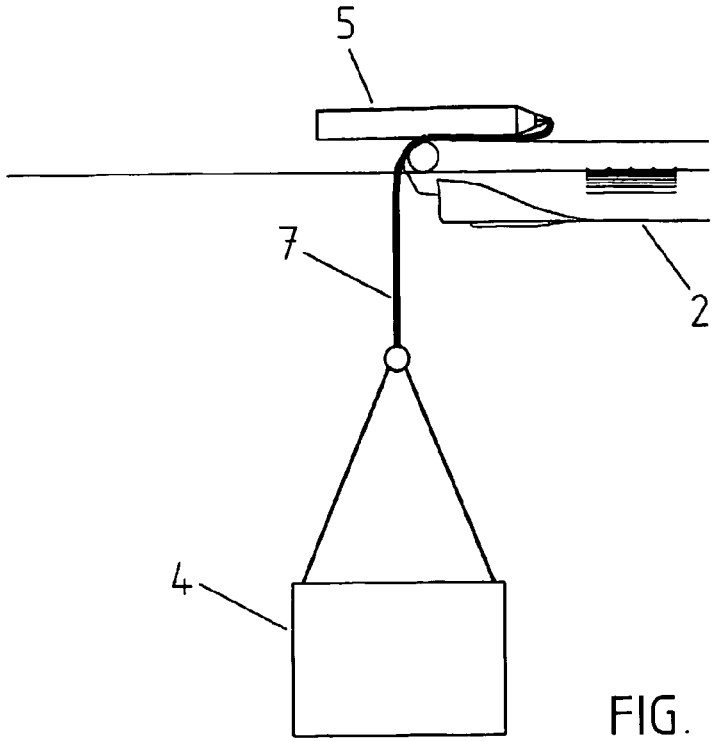
FIGS. 3A–F are side views illustrating the launch of the buoyancy unit with subsequent weight transfer from towing winch to buoyancy unit.
Figure 3B:
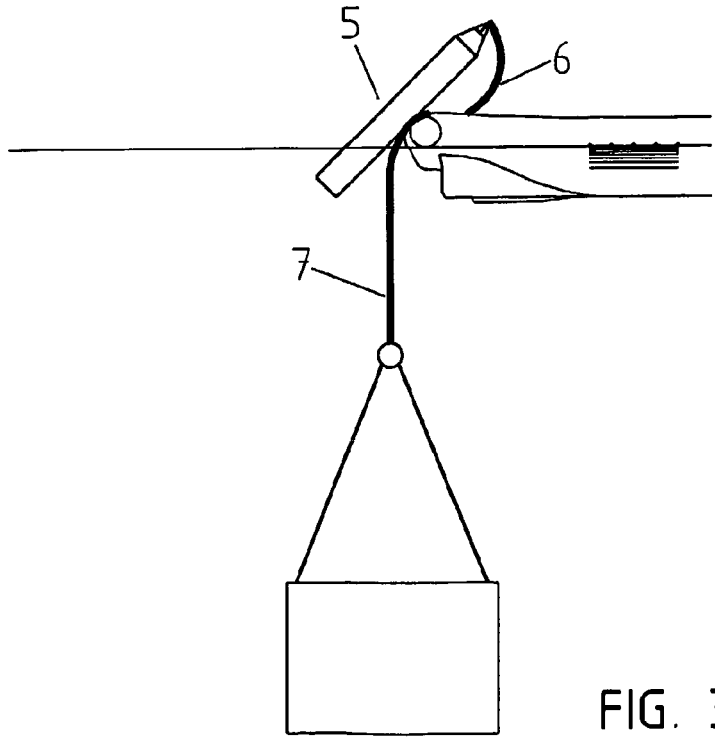
Figure 3C:
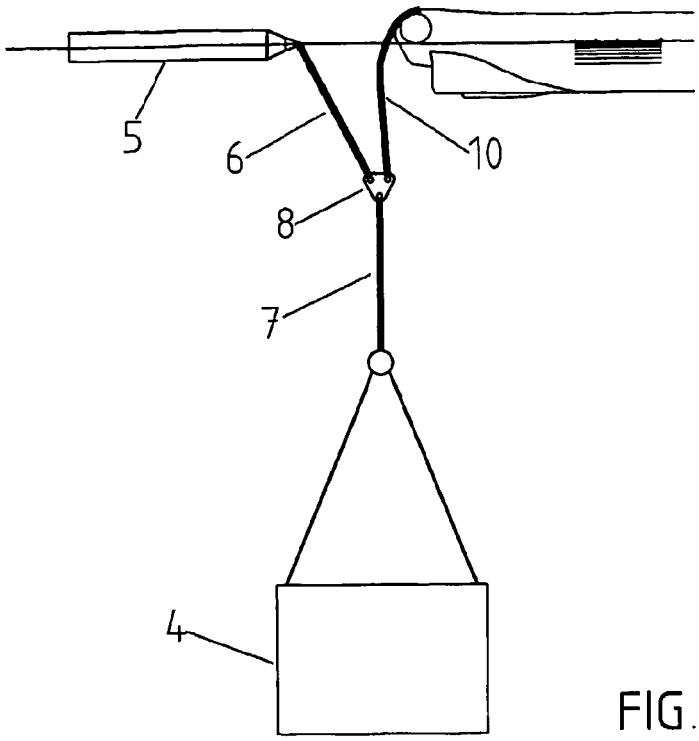
Figure 3D:
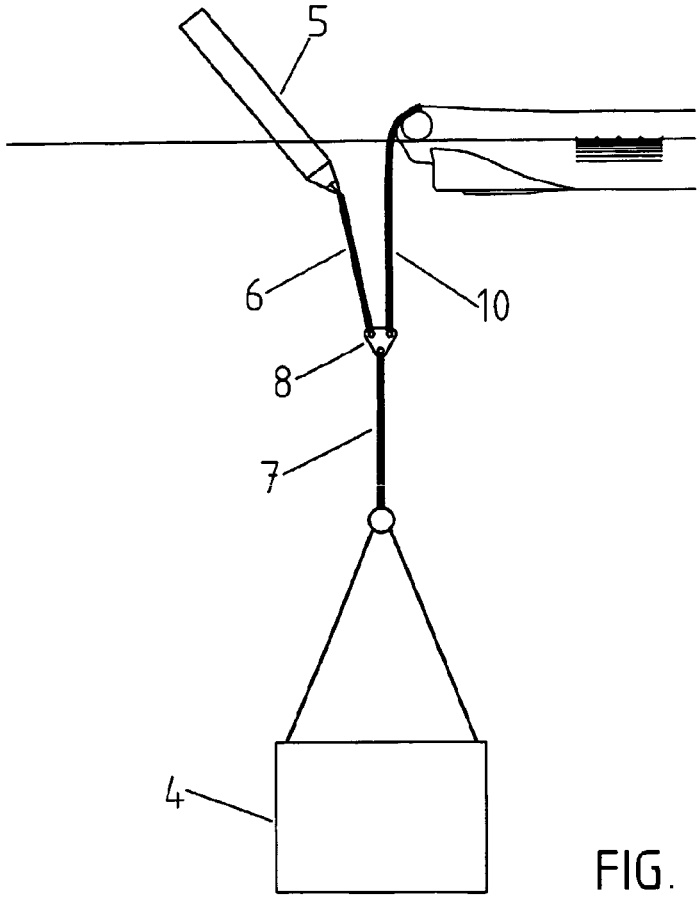
Figure 3E:
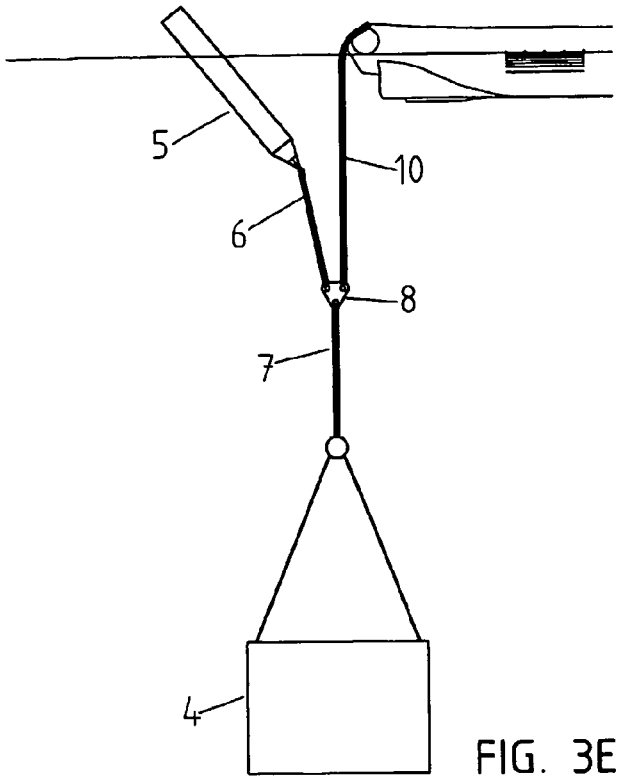
Figure 3F:
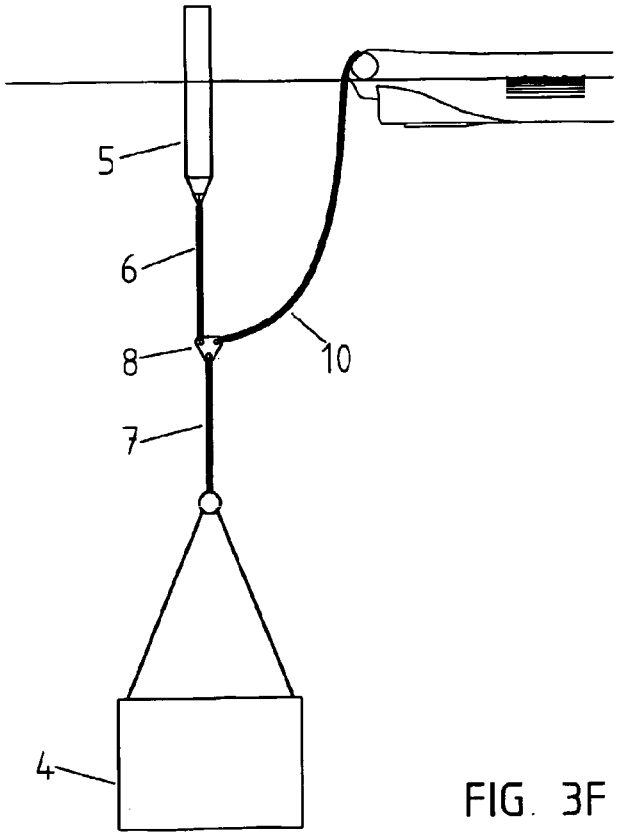

FIGS. 3A–F show the launch of the buoyancy unit 5 from the towing vessel 2 and the subsequent object 4 weight transfer from the towing winch 3 to the buoyancy unit. In FIGS. 3A–C the towing winch wire 10 is paid out and the buoyancy unit 5 is thereby pulled off the deck by means of the object 4 weight. This launch operation is performed with the vessel 2 in forward motion. In FIGS. 3D and E the towing wire continues to be paid out and the buoyancy unit starts to take some of the object weight and is thereby raised towards a vertical position. In FIG. 3F the buoyancy unit 5 has taken the full weight of the object 4.

Figure 4:
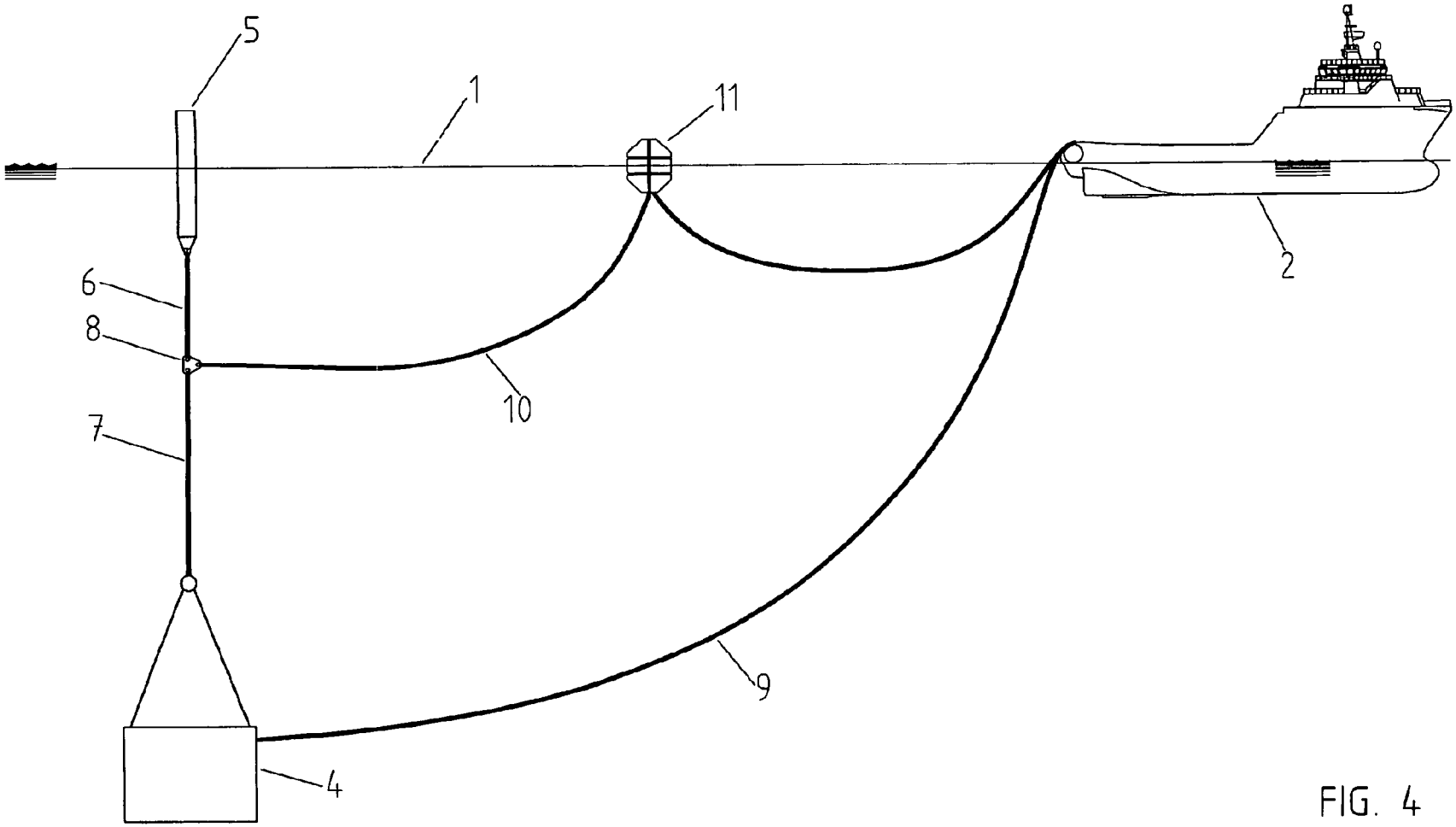
FIG. 4 is a side view illustrating the invention during the transport phase, with an object suspended from a slender buoyancy unit and connected via a towing arrangement to a towing vessel.

FIG. 4 shows the towing situation of the present invention wherein the towing vessel 2 is an anchor handling tug with an onboard heave compensated winch. Further, the object 4 is shown suspended from the cylindrical buoyancy unit 5, which are connected to each other by a suspension arrangement 6, 7, 8. The winch wire from the anchor handling tug, or other heave compensated winch, is used as towing wire 10. The towing wire is connected to a buoy 11, which relieves the buoyancy unit of the weight of the towing wire. If required, the directional stability of the towed object 4 may be controlled by a guideline, denoted 9.

The buoyancy unit 5 has a long, slender, cylinder shape with a small and mainly constant waterplane area and a tapered lower end. The unit will preferably be a steel structure that may be divided into several watertight compartments, a principle that will ensure continued buoyancy in case of leakage or damage to one or more of the compartments. In the lower tapered end of the buoyancy unit there may be a padeye arrangement for connection of the suspension arrangement 6–8 between the suspended object 4 and the buoyancy unit 5. The buoyancy unit may also be fitted with a ballast system which, as required, can be utilised to adjust the vertical position of the buoyancy unit 5 in the water, and also enable connection or disconnection of a liftline between the buoyancy unit and the object.

The main purpose of the buoyancy unit 5 is to keep the towed object 4 afloat and in the capacity of its shape act as a heave compensator and thereby minimise the dynamic loads in the towed object 4 and the suspension arrangement 6, 7, 8 between the object and the buoyancy unit 5. The heave compensation achieved by this principle is not limited by e.g. a defined cylinder stroke length, as large waves will wash over the buoyancy unit. Thus, the resulting changes in dynamic loads will be small in the towed object 4 and the suspension arrangement 6–8 between object and buoyancy unit.

The suspension arrangement 6, 7, 8 between the slender buoyancy unit 5 and the object may consist of two parts 6, 7 connected together by a link 8, preferably a tri-plate. The purpose of dividing the arrangement in such a manner is to be able to pull the tri-plate 8 onto deck for connection and disconnection of the towing wire 10 to the suspension arrangement, while the object 4 is still hanging below surface 1.

The actual towing force is acting in the link 8 between the upper 6 and lower 7 part of the suspension arrangement, in such a way that neither the towed object 4 nor the buoyancy unit 5 is directly connected to the towing wire 10.

Figure 5A:
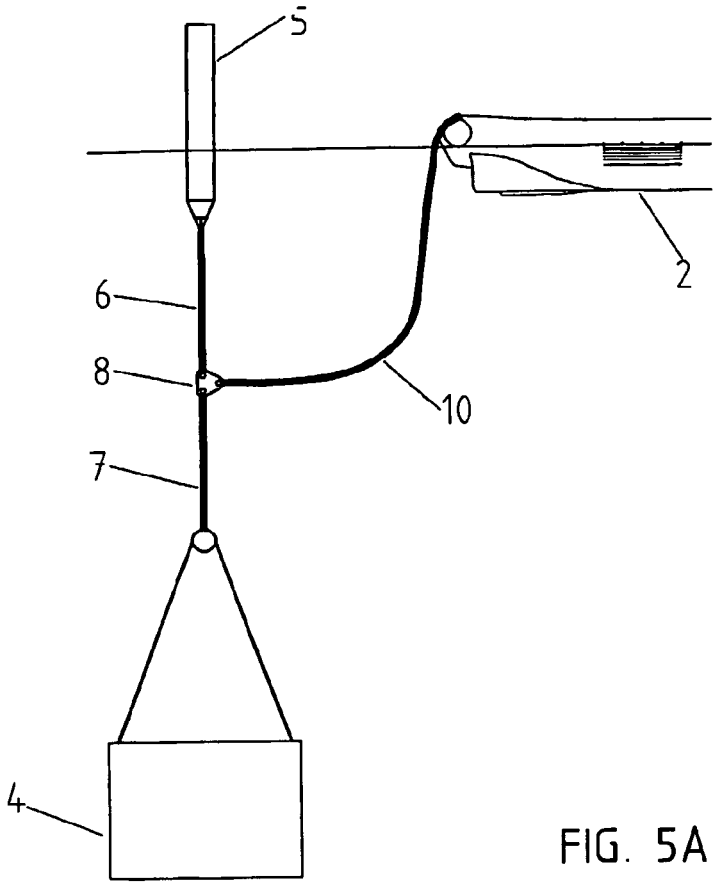
FIGS. 5A–F are side views illustrating the end of tow situation where the object weight is transferred from the buoyancy unit to the towing winch, with subsequent disconnection and recovery of the buoyancy unit.
Figure 5B:
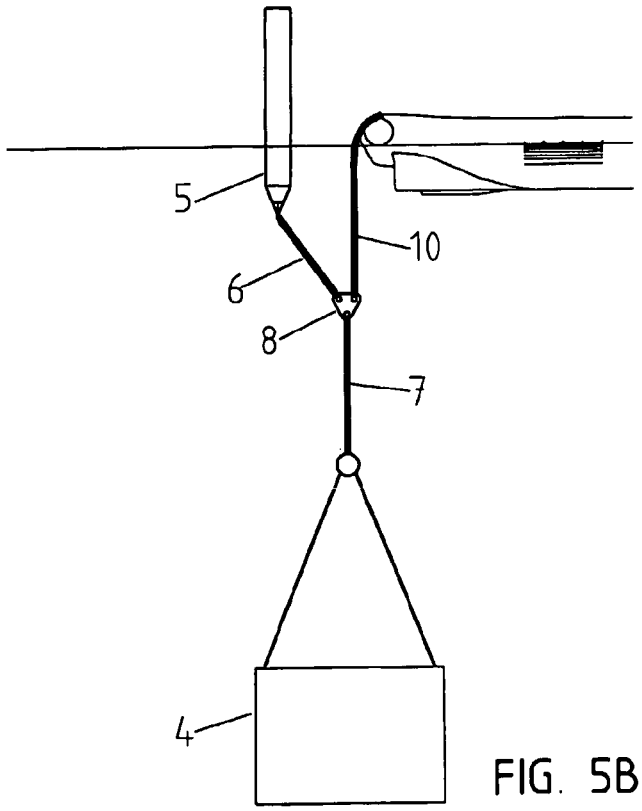
Figure 5C:
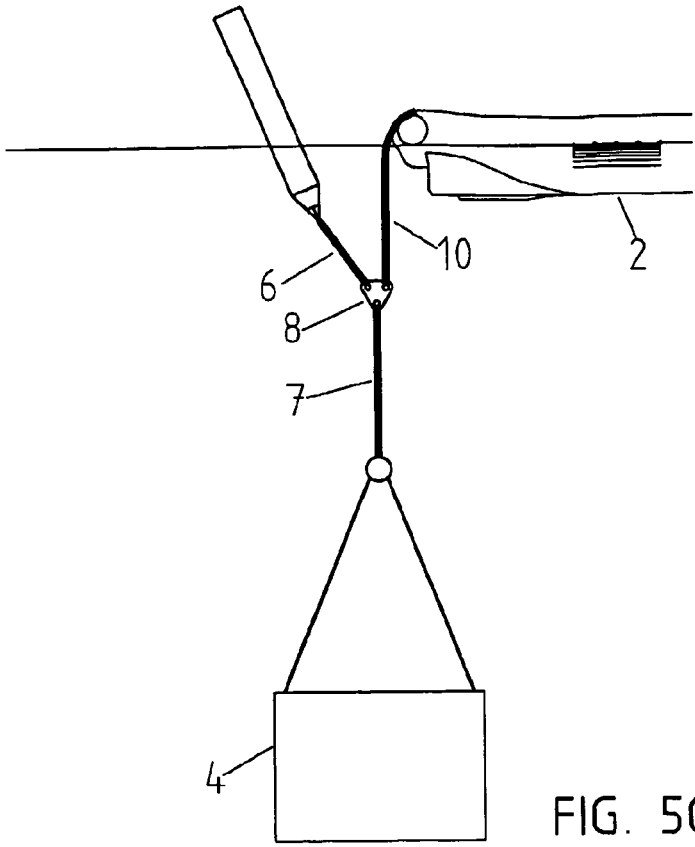
Figure 5D:
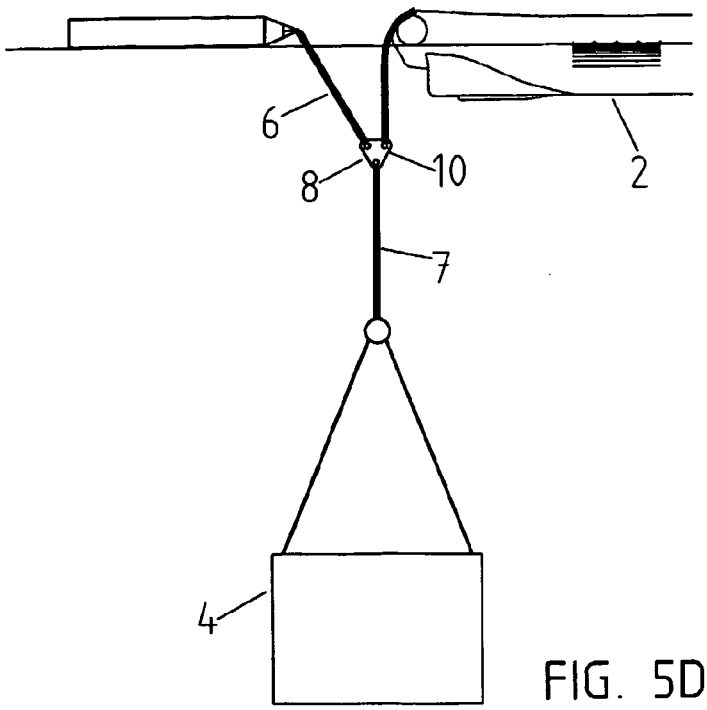
Figure 5E:
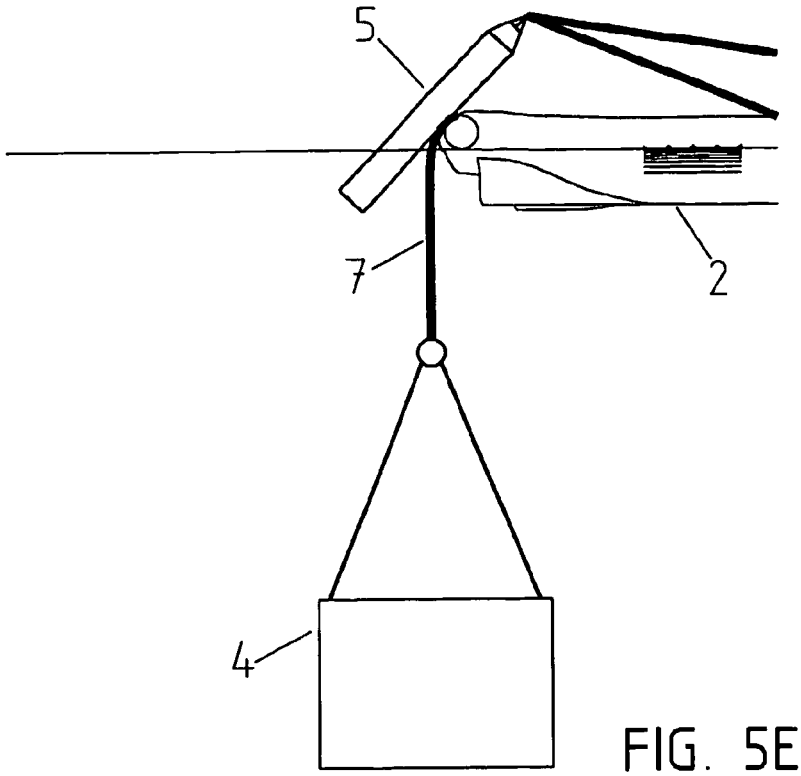
Figure 5F:
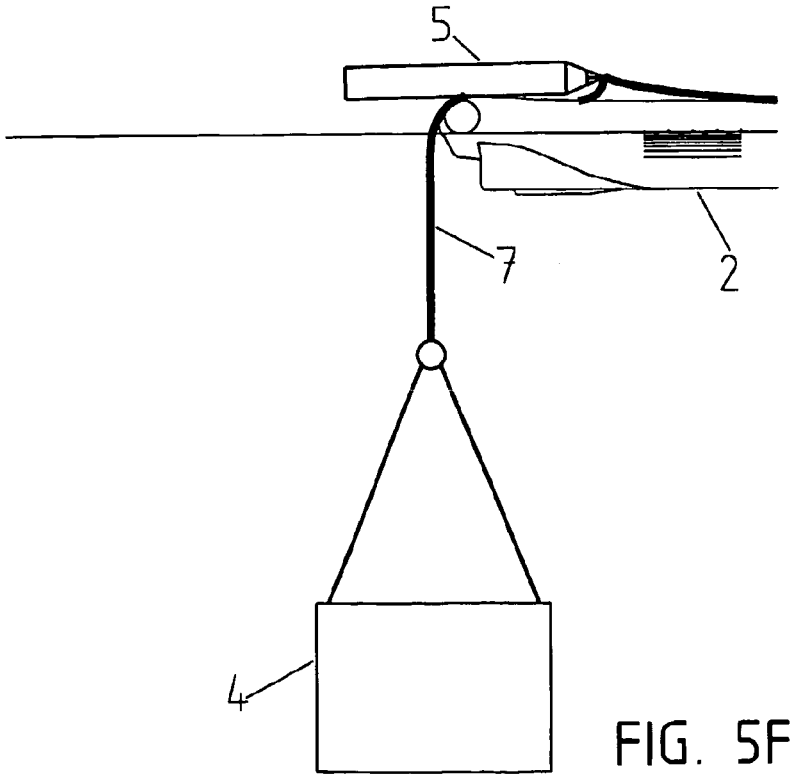

FIGS. 5A–F show the end of the tow when the destination is reached, with weight transfer from buoyancy unit 5 to the towing winch 3 and subsequent recovery of the buoyancy unit. In FIGS. 5A–D the towing winch wire 10 is hauled in to take the weight of the object 4. The buoyancy unit will gradually take less of the object load until it is floating horizontally on the surface without carrying any load. In FIG. 5E the buoyancy unit is disconnected from the object 4 and a recovery winch (not shown) is attached to it for recovery of the buoyancy unit onto deck of the towing vessel 2. In FIG. 5F the buoyancy unit is lying on deck of the towing vessel while the object is hanging in the winch wire ready for deployment towards seabed.

Figure 6:
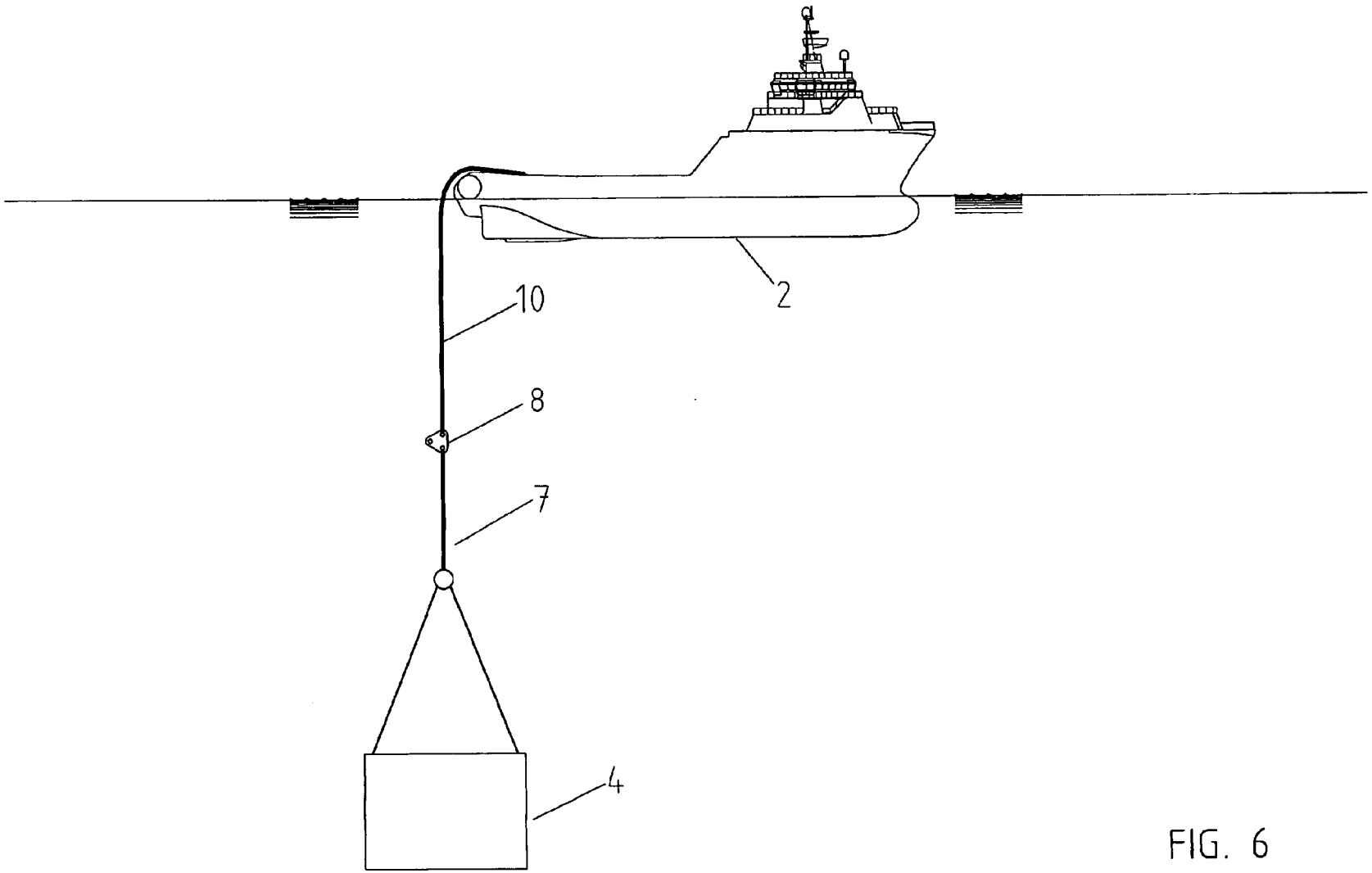
FIG. 6 is a side view showing the lowering of the object towards seabed or target depth for installation.

FIG. 6 shows the object 4 being lowered towards seabed for final installation. A clump weight and orientation wires (not shown) are typically used as installation aids for positioning of the object at the seabed.

The vessel 2 used for towing the object 4 will according to the invention preferably also be used for installation of the object upon arrival at the destination, as the object 4 then is lowered to the seabed using the towing winch wire 10. However, the method according to the invention is not limited to using the same vessel for transport and installation, and the method according to the invention could thus include using more than one vessel. The vessel performing the installation or recovery offshore may be any type of vessel, self-propelled or not, with a heave compensated lifting arrangement.

The method is intended for use with only one slender buoyancy unit 5 for transport and installation of relatively compact objects where the structural design is such that it can be lifted or carried in a single point using a lift bridle or similar. Moreover, the method may be used with two or more equivalent slender buoyancy units when the object has a structural design that requires two or more points for lifting/carrying to ensure the integrity of the structure during the transport and installation, according to the Invention, e.g. for transport and installation of large pipe spoolpieces.

In relation to spool piece installation, the method according to the invention is considered not only applicable for installation of single spoolpieces, but is also applicable for transport and installation of several spoolpieces simultaneously. This is made possible by having a number of spoolpieces stacked, or in other way placed, in a basket or transportation frame that will be suspended from the buoyancy unit as per the method according to the invention. The transportation frame may then be lowered to the seabed and wet parked on arrival at the destination, and the spoolpieces may then be picked up from the basket one by one and installed.

In addition to transport and subsequent installation of objects, the method according to the invention is also suitable for removal of objects and transportation of these to shore. This is beneficial when a field is to be decommissioned or when objects are to be removed for other reasons, e.g. repair or replacement. Some objects are also unfit for recovery to the surface and lifting onto deck of a construction vessel or a transportation barge due to cost or technical limitations like large object dimensions and/or weight. The step by step method for removal and subsequent transport to shore of an object will in principle be the reverse of the step by step method already outlined for installation of an object. It is envisioned that removal of structures using the method also may include e.g. removal of jackets, as these may be laid down on the seabed for subsequent recovery and transport to shore using the method according to the invention. The removal method is defined in claim 2.

The method may also be used to install objects that in operation are to be located mid-water, i.e. in a position below the sea surface, between the seabed and the critical wave zone. Such an object is e.g. an Artificial Buoyant Seabed (ABS), also referred to as Atlantis. The method according to the invention is in this respect not limited to installing or recovering objects on the seabed, but also involves installing or recovering objects from mid-water positions.

Another possible utilisation of the method is to have at least one winch mounted on the buoyancy unit itself, to be used for controlled lowering of the object towards seabed or target depth between seabed and sea surface. Due to its shape, the buoyancy unit acts as a heave compensator and thereby minimises the dynamic loads in the winch wire, lift arrangement and object during the lowering and final landing, and makes the lowering and landing operations independent of installation vessel motions. Alternatively, the same advantages may be gained by having a sheave arrangement or similar mounted on the buoyancy unit itself, with at least one sheave or similar. At least one winch from at least one vessel may then be routed over the sheave arrangement and further connected to the object for lowering and final landing of the object. These utilisations of the method may also be used for recovery operations.

If the tow will encounter more shallow depths underway where the submerged object 4 could possibly hit the sea bottom, it is envisioned that when passing such waters, the object 4 is raised somewhat by bringing the buoyancy unit into a horizontal position. This could be done in various ways, e.g. by connecting a wire between the triplate 8 and the top of the buoyancy unit and then shortening this wire until it has the same length as the upper suspension wire 6.

The invention is not limited to the exemplifying embodiment described herein, but may be varied and modified by the skilled person within the scope of the appended claims.

What is claimed is:

1. A method for transport and installation of objects at sea, particularly relating to transport and installation of subsea objects that are part of the infrastructure in oil and gas fields offshore, where the object is put in the sea at a suitable location near the shore or in sheltered waters, then towed to the installation site while being suspended via a suspension arrangement of a predetermined length in at least one floating buoyancy unit, and subsequently lowered to its final destination, wherein use is made of at least one slender upright buoyancy unit, which also is used as a heave compensator during the towing and thereby reduces the dynamic loads in the towed object and the suspension arrangement between the towed object and the buoyancy unit, and that upon arrival at the installation site, the suspension of the object is transferred from said at least one buoyancy unit to a heave compensated winch on a surface vessel while the buoyancy unit is disconnected, said winch being used to lower the object to its destination on the sea bottom or a predetermined location above the sea bottom.

2. A method according to claim 1, wherein the freeboard of the or each buoyancy unit is set so small that large waves will wash over the buoyancy unit, whereby the resulting changes in dynamic loads will be small in the towed object and the suspension arrangement between object and buoyancy unit.

3. A method according to claim 1, wherein the or each buoyancy unit has a constant diameter along the longitudinal axis, has a tapered lower end, and is divided into several watertight compartments to ensure continued buoyancy in case of leakage or damage to one or more compartments, and in the lower tapered end has a padeye arrangement for connection of the suspension arrangement between the suspended object and the buoyancy unit.

4. A method according to claim 1, wherein the or each buoyancy unit is fitted with a system for ballasting, for the purpose of adjusting the vertical position of the buoyancy unit in the water and thus enable connection or disconnection of a liftline between the buoyancy unit and an object on the seabed or an object in a position mid-water, or for the purpose of selecting the draft and freeboard of the buoyancy unit in the upright position to adjust the motion behaviour.

5. A method according to claim 1, wherein a towing arrangement is used comprising a towing line which connects the buoyancy unit and object with a towing vessel.

6. A method according to claim 5, wherein the towing arrangement further comprises a guideline between the vessel and object to control the directional stability of the towed object.

7. A method according to claim 5, wherein the towing line in the towing arrangement is the same winch wire of the towing vessel winch system which is utilized for lowering or raising the object during installation or removal, respectively.

8. A method according to claim 1, wherein the suspension arrangement that connects the object to the buoyancy unit comprises a lower part and an upper part connected together with a link, preferably a tri-plate, to enable connection and disconnection of a towing line to the suspension arrangement on the deck of a towing vessel.

9. A method according to claim 1, wherein the vessel used for lowering or raising the object is also used for towing the object.

10. A method according to claim 2, wherein the vessel used for lowering or raising the object is also used for towing the object.

11. A method for removal and transport of objects at sea, particularly relating to removal and transport of objects that are part of the infrastructure in oil and gas fields offshore, where the object is recovered from the seabed or a position between the seabed and sea surface, with subsequent tow to a predetermined place, wherein the object is raised to a predetermined distance below the surface by means of a winch on a surface vessel, whereupon the suspension of the object is transferred via a suspension arrangement of a predetermined length to at least one floating buoyancy unit before the tow is started, wherein use is made of a heave compensated winch during the raising, and further that use is made of a slender upright buoyancy unit, which is also used as a heave compensator during the towing and thereby reduces the dynamic loads in the towed object and the suspension arrangement between the towed object and the buoyancy unit.

12. A method according to claim 11, wherein the freeboard of the or each buoyancy unit is set so small that large waves will wash over the buoyancy unit, whereby the resulting changes in dynamic loads will be small in the towed object and the suspension arrangement between object and buoyancy unit.

13. A method according to claim 11, wherein the or each buoyancy unit has a constant diameter along the longitudinal axis, has a tapered lower end, and is divided into several watertight compartments to ensure continued buoyancy in case of leakage or damage to one or more compartments, and in the lower tapered end has a padeye arrangement for connection of the suspension arrangement between the suspended object and the buoyancy unit.

14. A method according to claim 11, wherein the or each buoyancy unit is fitted with a system for ballasting, for the purpose of adjusting the vertical position of the buoyancy unit in the water and thus enable connection or disconnection of a liftline between the buoyancy unit and an object on the seabed or an object in a position mid-water, or for the purpose of selecting the draft and freeboard of the buoyancy unit in the upright position to adjust the motion behaviour.

15. A method according to claim 11, wherein a towing arrangement is used comprising a towing line which connects the buoyancy unit and object with a towing vessel.

16. A method according to claim 15, wherein the towing arrangement further comprises a guideline between the vessel and object to control the directional stability of the towed object.

17. A method according to claim 15, wherein the towing line in the towing arrangement is the same winch wire of the towing vessel winch system which is utilized for lowering or raising the object during installation or removal, respectively.

18. A method according to claim 11, wherein the suspension arrangement that connects the object to the buoyancy unit comprises a lower part and an upper part connected together with a link, preferably a tri-plate, to enable connection and disconnection of a towing line to the suspension arrangement on the deck of a towing vessel.

19. A method according to claim 11, wherein the vessel used for lowering or raising the object is also used for towing the object.

20. A method according to claim 12, wherein the vessel used for lowering the object is also used for towing the object.

* * * * *